US010688372B2

(12) United States Patent
Chen

(10) Patent No.: US 10,688,372 B2
(45) Date of Patent: Jun. 23, 2020

(54) PULLEY TOP ENCLOSURE POLE

(71) Applicant: Samuel Chen, Causeway Bay (CN)

(72) Inventor: Samuel Chen, Causeway Bay (CN)

( * ) Notice: Subject to any disclaimer, the term of this patent is extended or adjusted under 35 U.S.C. 154(b) by 46 days.

(21) Appl. No.: 15/972,460

(22) Filed: May 7, 2018

(65) Prior Publication Data

US 2019/0091540 A1 Mar. 28, 2019

(30) Foreign Application Priority Data

Sep. 26, 2017 (CN) ..... 2017 2 1240391 U

(51) Int. Cl.

*A63B 71/02* (2006.01)
*A63B 5/11* (2006.01)
*A63B 1/00* (2006.01)

(52) U.S. Cl.

CPC ..... *A63B 71/022* (2013.01); *A63B 1/00* (2013.01); *A63B 5/11* (2013.01); *A63B 71/023* (2013.01); *A63B 2225/093* (2013.01)

(58) Field of Classification Search

CPC .. A63B 5/08; A63B 5/085; A63B 5/11; A63B 5/16; A63B 6/00; A63B 9/00; A63B 2009/002; A63B 2009/004; A63B 2009/006; A63B 2009/008; A63B 1/00; A63B 71/022; A63B 71/023; A63B 71/0054; A63B 2225/093; A63B 2071/0063; A63B 2209/02

See application file for complete search history.

(56) References Cited

U.S. PATENT DOCUMENTS

| | | | | |
|---|---|---|---|---|
| 3,180,622 | A * | 4/1965 | Romeo Fillion | A01K 73/06 212/309 |
| 5,215,310 | A * | 6/1993 | Allbright | A63B 61/02 473/493 |
| 5,358,257 | A * | 10/1994 | Pardi | A63B 61/02 473/493 |
| 5,788,606 | A * | 8/1998 | Rich | A63B 69/0064 482/27 |
| 6,219,959 | B1 * | 4/2001 | Hsieh | E05G 5/02 109/3 |
| 7,713,174 | B2 * | 5/2010 | Xiang | A63B 5/11 482/27 |
| 9,283,419 | B2 * | 3/2016 | Chen | A63B 5/11 |
| 9,687,719 | B1 * | 6/2017 | Chen | A63B 5/11 |
| 10,265,562 | B2 * | 4/2019 | Woodman | A63B 5/11 |
| 2005/0065004 | A1 * | 3/2005 | Liao | A63B 22/14 482/142 |

(Continued)

*Primary Examiner* — Megan Anderson
(74) *Attorney, Agent, or Firm* — Clement Cheng

(57) ABSTRACT

A trampoline includes a trampoline frame with trampoline legs supporting the trampoline frame above a ground. Trampoline springs connect to the trampoline frame. A trampoline bed is connected to the trampoline springs. The trampoline bed is extended across the trampoline frame. A trampoline enclosure has at least one enclosure pole supporting an enclosure net. A pulley system is mounted to the enclosure pole and the pulley system includes a pulley mounted to a pulley line. The pulley line connects to an enclosure top support. The enclosure net is connected to the enclosure top support. Optionally, the trampoline also has a free end of the pulley line. The free end of the pulley line extends away from the pulley to be accessible to a user.

7 Claims, 5 Drawing Sheets

(56) References Cited

U.S. PATENT DOCUMENTS

| | | | | |
|---|---|---|---|---|
| 2006/0270525 | A1* | 11/2006 | Colling | A63B 5/11 482/27 |
| 2011/0205555 | A1* | 8/2011 | Lorhpipat | A63B 61/04 356/625 |
| 2017/0232319 | A1* | 8/2017 | Nelson | A63B 69/00 473/446 |

* cited by examiner

PULLEY TOP ENCLOSURE POLE

FIELD OF THE INVENTION

The present invention is in the field of sports enclosures.

DISCUSSION OF RELATED ART

Trampolines have a variety of enclosures for keeping users within a jumping area which is typically above the trampoline bed. The trampoline enclosures typically include a net for retaining users. The net is typically supported by poles. Unfortunately, since the net is supported above a height of the jumping area, the enclosures need to be hoisted by a user assembling them. Users may need ladders to reach a height for securing the net to the pole.

A variety of different trampoline enclosure nets have enclosure pole connection mechanisms. For example, in U.S. Pat. No. 7,713,174 entitled Trampoline Enclosure Net issued May 11, 2010, by inventor Xiang assigned to Sportspower Ltd., a trampoline enclosure net with a rebounding assembly is supported by a connection assembly that has a hanging hook to expand and contract and buffer impact by a user, the disclosure of which is incorporated herein by reference.

SUMMARY OF THE INVENTION

A trampoline includes a trampoline frame with trampoline legs supporting the trampoline frame above a ground. Trampoline springs connect to the trampoline frame. A trampoline bed is connected to the trampoline springs. The trampoline bed is extended across the trampoline frame. A trampoline enclosure has at least one enclosure pole supporting an enclosure net. A pulley system is mounted to the enclosure pole and the pulley system includes a pulley mounted to a pulley line. The pulley line connects to an enclosure top support. The enclosure net is connected to the enclosure top support. Optionally, the trampoline also has a free end of the pulley line. The free end of the pulley line extends away from the pulley to be accessible to a user. The user can pull on the free and of the pulley line to raise the trampoline enclosure net.

The trampoline pulley system also preferably has a tensioner having a tensioner handle so that the user can control a tension of the pulley line using the tensioner handle. The tensioner engages the pulley line to increase tension by retaining the pulley line with a variable force. A pulley notch can be formed on the pulley so that the pulley notch is configured to retain a portion of the enclosure top support. The pulley system may also have an endcap securing the pulley to the at least one enclosure pole. The end cap has an endcap socket for fitting over an upper end of the at least one enclosure pole.

The trampoline also may have an end cap notch wherein the end cap notch is configured to receive and retain a portion of the enclosure top support. The trampoline of may also have a spring cover covering the trampoline springs. The spring cover can be inflatable so that it is hollow and filled with air or water. The enclosure net can be made as a double net with an inside net attached to an inside circumference of the spring cover and with an outside net attached to an outside circumference of the spring cover.

A variety of net control systems have included pulleys for controlling ropes and nets. For example, in U.S. Pat. No. 5,215,310, entitled Volleyball Net Support And Tensioning System, patented by Allbright and issued on Jun. 1, 1993, describes a pulley arrangement that adjusts the tension applied to a net used primarily for volleyball. The pulley arrangement puts greater tension on the upper net cable instead of the lower net cable, for the purpose of adjusting the height of the net in a manner that is both easy and precise.

U.S. Pat. No. 6,219,959, entitled Net Trapping System For Capturing A Robber Immediately, invented by Hseih and issued on Apr. 24, 2001, describes a security system designed to prevent robberies from taking place. The system makes use of a net, which drops down and is lifted up with the robber in tow through the use of a main hanging rope, a lifting motor, and a pulley that allows for the net to be lifted.

U.S. Pat. No. 3,180,622, entitled Towing And Hoisting Crane For Fishing Vessels, invented by Romeo Fillion and issued on Apr. 27, 1965, describes a hoisting crane that is mounted on a fishing vessel and used to haul fish on said vessel. In order to hoist up the net that the crane is attached to, towing and hoisting wires are attached to two pulleys, which allow for the net to be pulled towards the vessel and onto the surface of the vessel.

The following callout list of elements can be a useful guide to referencing the element numbers of the drawings.

10 Strap
11 Inside Line Length
12 Outside Line Length
13 Enclosure Line Connection
14 Enclosure Top Line
15 Line Connection Support
16 Enclosure Net
17 Line Slot
18 Tensioner Shaft
19 Tensioner Handle
20 Pulley System
21 Endcap Socket
22 Pulley Shaft
23 Pulley
24 Pulley Groove
25 Slack Line End
26 Enclosure Pole
27 Upper Socket Connector
28 Lower Socket Connector
29 Endcap Body
30 Trampoline
31 Frame
32 Enclosure
33 Trampoline Bed
34 Trampoline Springs
35 Trampoline Legs
36 Spring Cover

37 Enclosure Pole Covers
41 Pulley Line Spring
42 Pulley Line Spring Retainer
43 Inside Net
44 Outside Net
45 Inside Net Lower Connection
46 Outside Net Lower Connection
47 Inside Net Upper Connection
48 Outside Net Upper Connection
51 Pulley Notch
52 Enclosure Top Support
53 Endcap Notch
54 Pulley Bearing
55 Pulley Retainer Opening
56 Retaining Stopper

DETAILED DESCRIPTION OF THE PREFERRED EMBODIMENT

Figure 7:
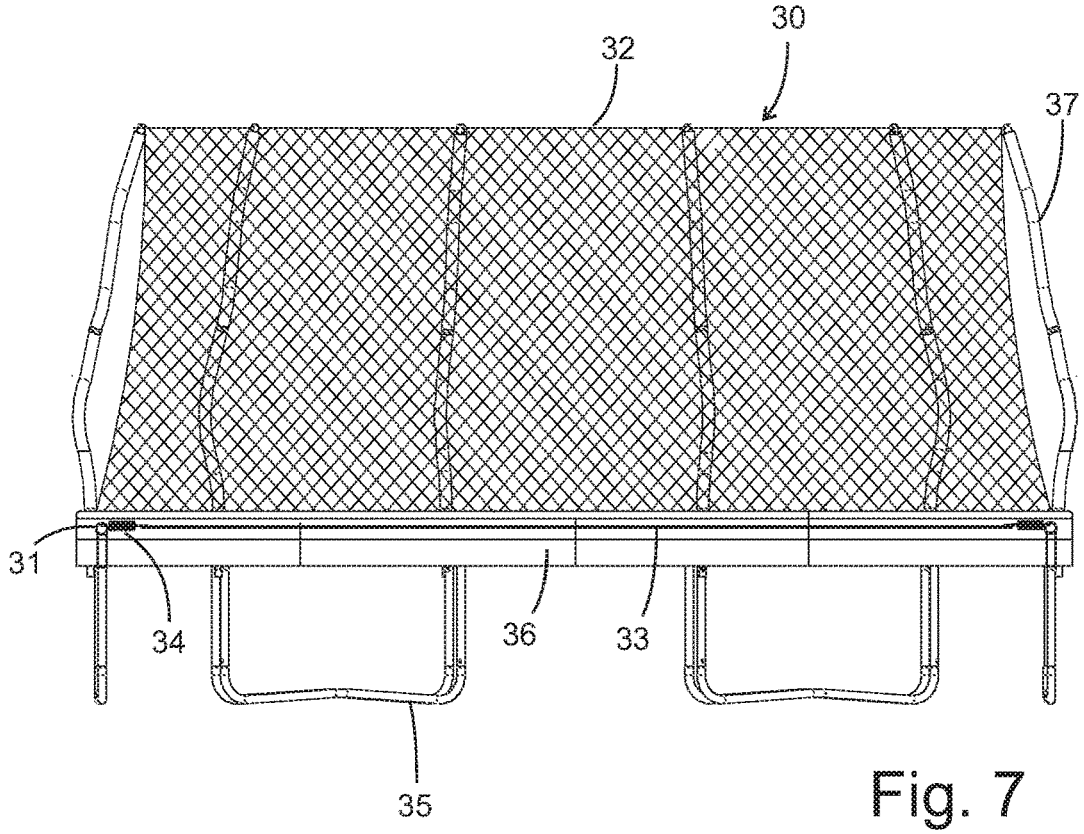
FIG. 7 is a side view of the trampoline.

As seen in FIG. 7, a trampoline 30 generally has a frame 31 an enclosure having generally horizontal members and generally vertical members. The trampoline frame 31 has a trampoline bed 33 stretched across it. The trampoline frame 31 has an enclosure 32 mounted to it. The trampoline frame 31 also has a plurality of trampoline legs 35 mounted to support the trampoline frame 31 above the ground. The trampoline bed 33 is connected in tension to the horizontal members of the trampoline frame 31 at trampoline springs 34. The trampoline springs maintain a tension of the trampoline bed 33 so that a user can bound on the trampoline bed 33. Preferably, spring covers 36 cover the springs and the trampoline frame 31. The spring covers can be formed as a pad like a sheet or a padding having a foam thickness. The enclosure 32 has an enclosure net suspended from several enclosure poles. Preferably, the enclosure poles are connected to each other at their tops to provide a flexible structure. The enclosure poles have enclosure pole covers 37 to provide a cushion against impact.

The enclosure poles are optionally of an oval cross-section. The oval cross-section can be oriented toward the trampoline bed so that the long portion of the oval cross-section points toward the trampoline bed. The springs can be larger than regular springs by 300%.

The spring covers 36 can be formed as inflatable air cushions with or without additional foam padding. The enclosure net can be a double net with an inside net having a tighter weave than an outside net. The inside net can have a finer mesh weaving made of a thinner line than an outside net which is made of a thicker line. The double enclosure net can be attached to the spring cover 36 with the inside net attached to an inside circumference of the spring cover and with the outside net attached to an outside circumference of the spring cover. The inside circumference of the spring cover defines the periphery of the trampoline bed 33 available to the user as a bounding surface.

Figure 8:
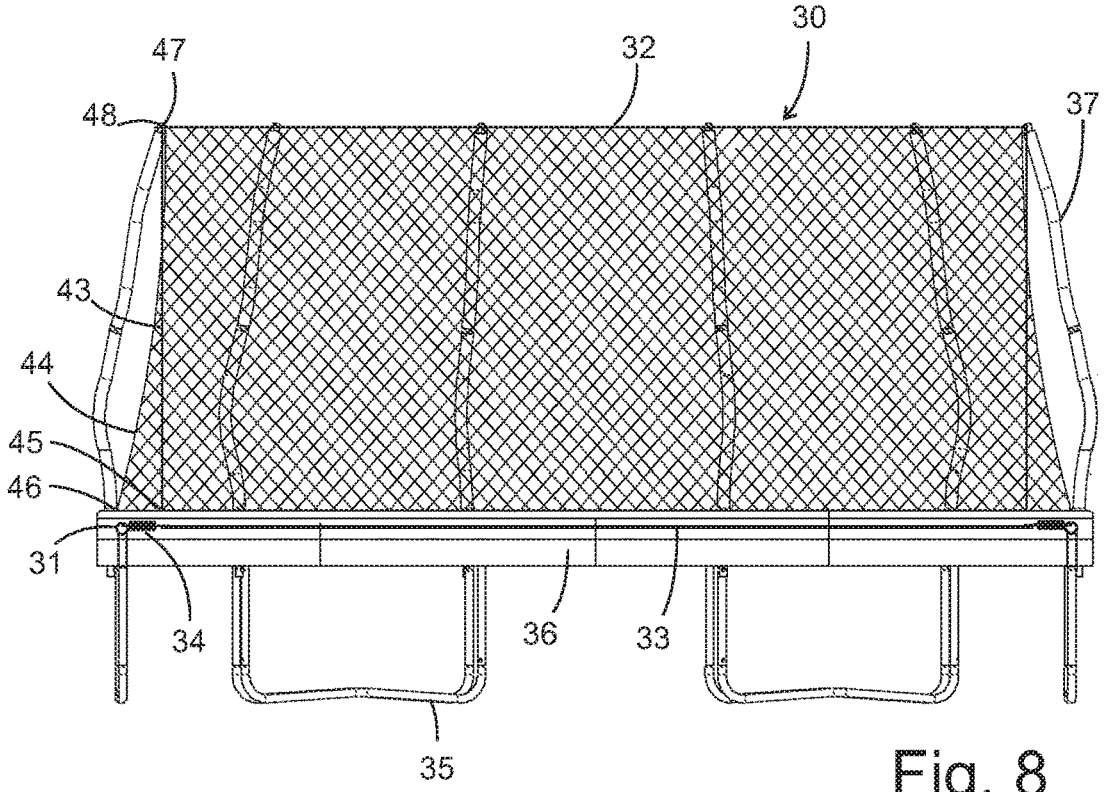
FIG. 8 is a side view of the trampoline.

As seen in FIG. 8, the inside net 43 is inside of the outside net 44. The inside net has an inside net lower connection 45 that is spaced apart from the outside net lower connection 46. The inside net lower connection 45 can connect to the inside portion of the springs 34 so that the inside net lower connection fits around the interior circumference of the spring cover. The outside net lower connection 46 can be connected to an external circumference of the spring cover such as at the trampoline frame 31. The outside net lower connection 46 can be a strap that connects to the trampoline frame 31 so that the outside net lower connection 46 is pulled to a position around the external circumference of the spring cover. The inside net upper connection 47 and the outside net upper connection 48 can be joined at the enclosure top support 52.

The present invention includes a pulley system 20 mounted at the top of an enclosure pole. The pulley system 20 includes a pulley line that can be formed as a strap 10 or as a cable that is held within the pulley groove 24 of the pulley 23. The pulley line has an inside line length 11 where the pulley line is between the pulley and the enclosure net and an outside line length 12 where the pulley is between the pulley line and the enclosure net. The outside line length 12 extends through a line slot 17. The line slot 17 can have a tensioner formed as a knob with the tensioner shaft 18 controlled by a tensioner handle 19. The inside tip of the tensioner shaft 18 can bear against the pulley line to secure the pulley line to the tensioner. Alternatively, the tensioner can provide slight tension or variable tension. A pulley line spring 41 can be inserted between the line slot 17 and attached to a pulley line spring retainer 42. The pulley line spring retainer 42 can be connected to the enclosure pole. The pulley line spring 41 can provide a spring elasticity for the pulley line to allow the pulley line to have an increased elasticity while still being under tension controlled by the tensioner handle 19 which can be adjusted.

A slack line end 25 extends downwardly from the outside line length 12. The slack line end 25 can hang free and can be pulled by a user for tightening the enclosure net 16. The net can be raised and lowered using the pulley. The slack line end 25 can include a weight such as a magnet attached to its end to keep it from becoming tangled. The magnet can secure to a portion of the enclosure pole 26 for example. The pulley line can be made as a strap having a flat cross-section or a cable having a round cross-section. The slack line end 25 is not completely slack, but has some tension that is lower than tension on the inside line length 11. The slack end 25 can be a free end that is outside of the enclosure pole.

The pulley 23 is mounted on a pulley shaft 22. The pulley shaft 22 can have a threaded connection to the endcap body 29. The pulley shaft 22 is mounted on the endcap body 29. The endcap body 29 has an endcap socket 21. The endcap socket 21 fits over an open end of an enclosure pole 26. The enclosure pole 26 is preferably formed as a metal tubular post that receives the endcap socket 21. The enclosure pole 26 is secured to the endcap socket 21 at an upper socket connector 27 and a lower socket connector 28. The upper socket connector 27 and the lower socket connector 28 can be formed as screws or bolts that pass through the endcap body 29 and the enclosure pole 26 at an upper end of the enclosure pole 26. The enclosure pole does not encapsulate or contain the pulley line.

The enclosure line connection 13 connects the inside line length 11 to the enclosure top line 14. The enclosure top line 14 is preferably reinforced by a structural member such as an enclosure top support 52. Adjacent to the enclosure line connection 13 is a line connection support 15 which can be a fabric panel that is stitched to the enclosure netting. The fabric panel reinforces the connection between the enclosure line connection 13 and the line connection support 15. The line connection support 15 secures the enclosure top line 14 to the enclosure line connection 13 and distributes stress more evenly through the enclosure net 16.

Figure 1:
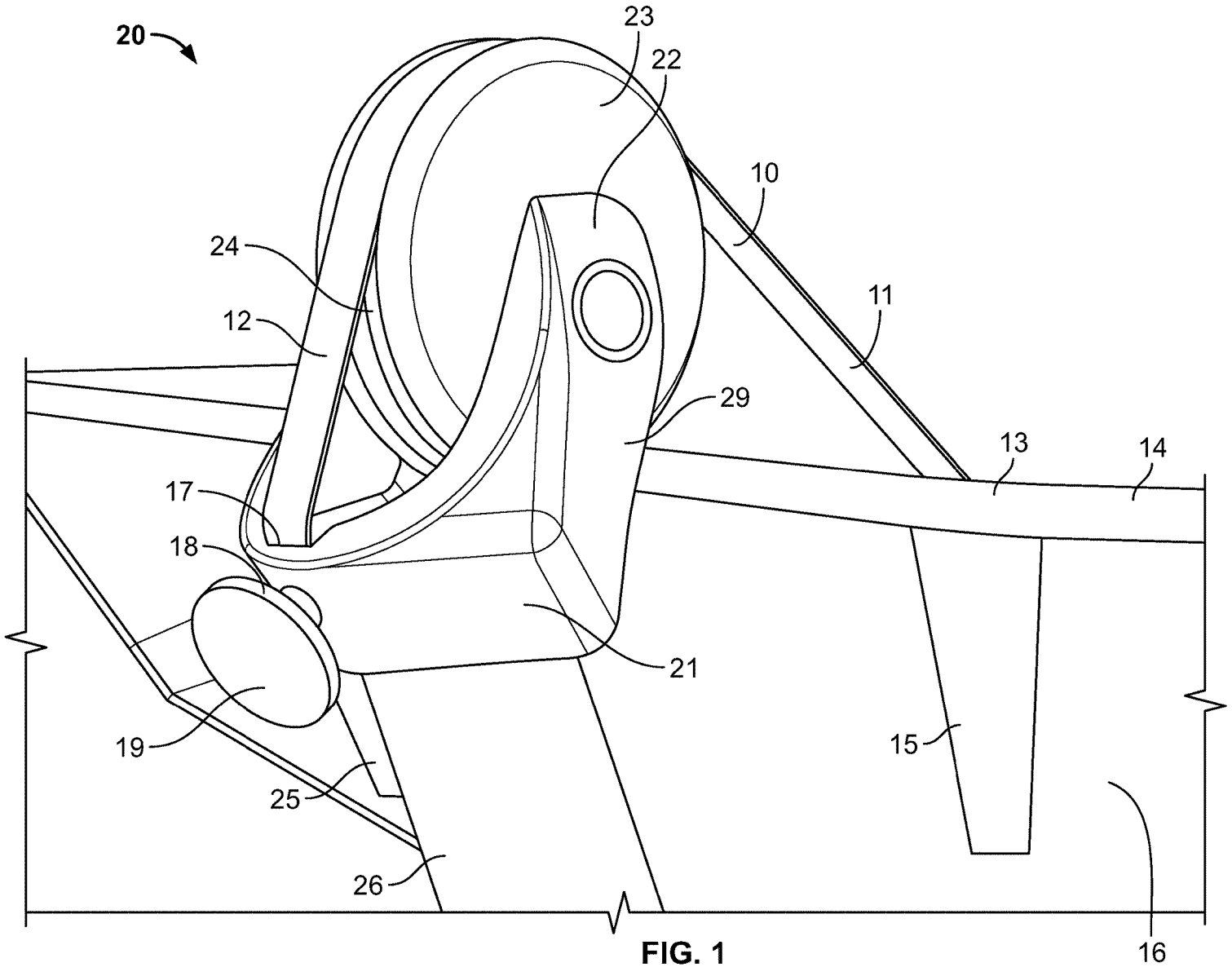
FIG. 1 is a perspective view of the pulley top enclosure pole retaining an enclosure net.
Figure 2:
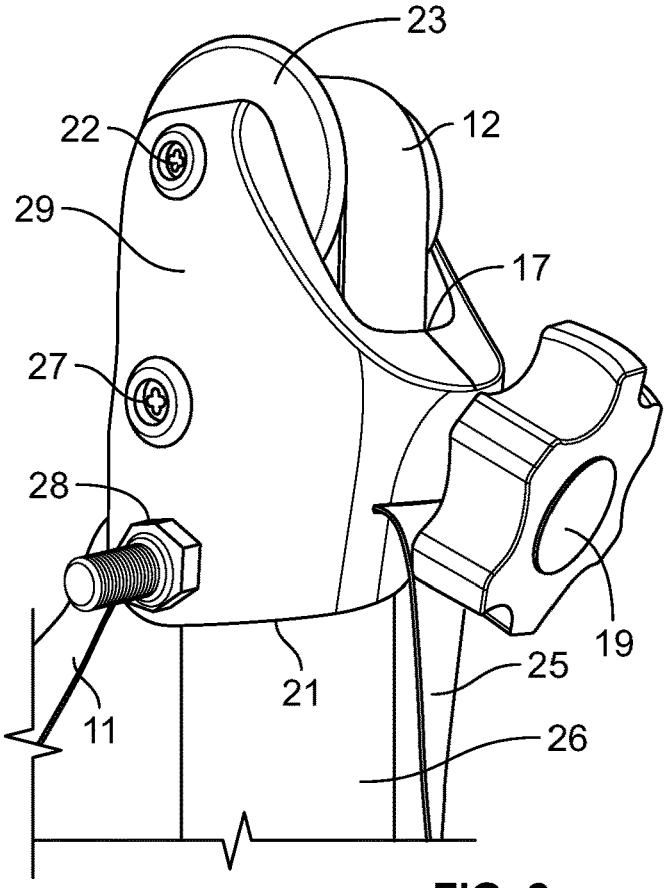
FIG. 2 is a right side view of the pulley top enclosure pole with a tensioning knob.
Figure 3:
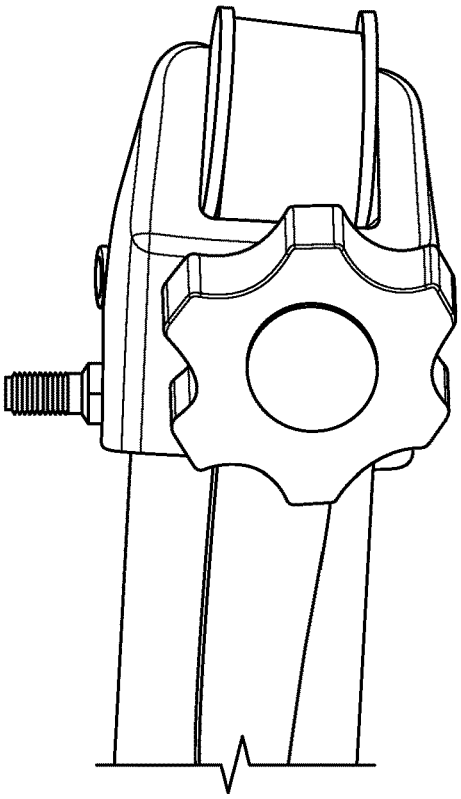
FIG. 3 is a rear view of the pulley top enclosure pole showing the tensioning knob.
Figure 4:
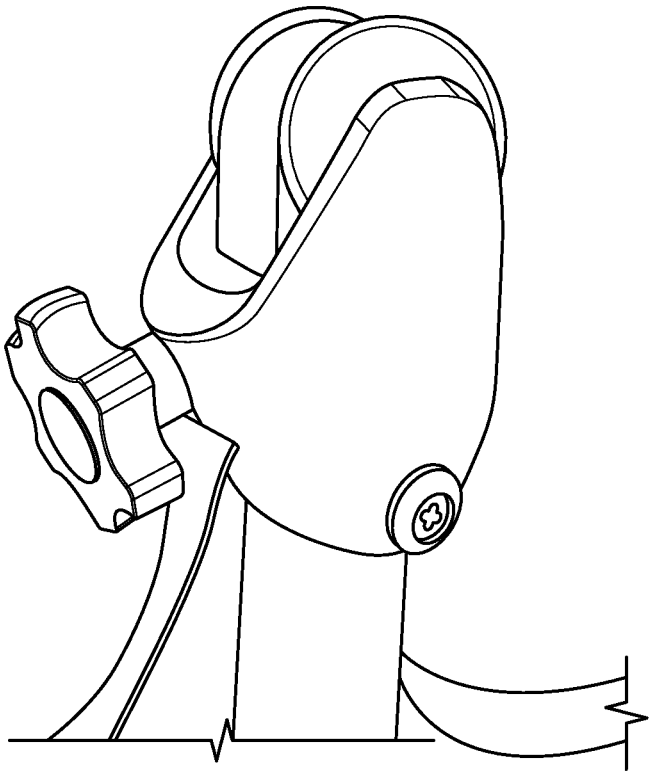
FIG. 4 is a rear left side view of the pulley top enclosure pole.
Figure 5:
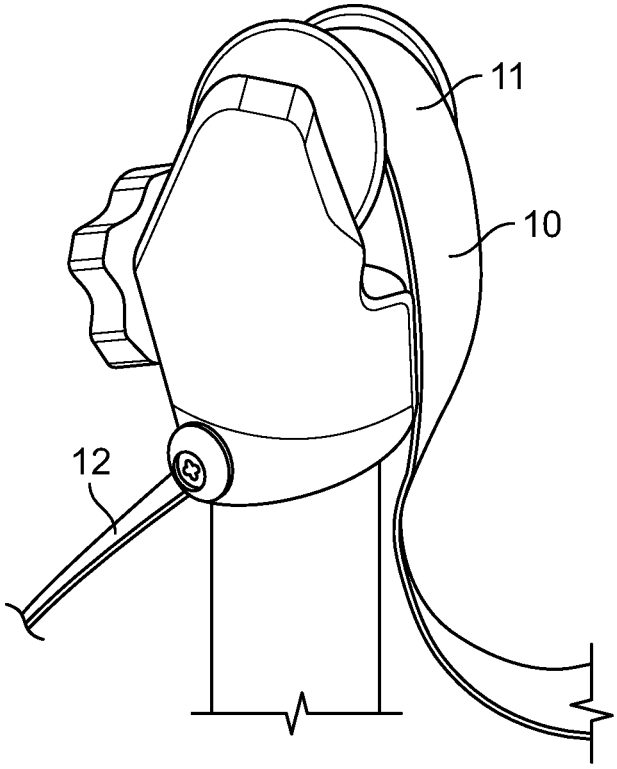
FIG. 5 is a front left side view of the pulley top enclosure pole.
Figure 6:
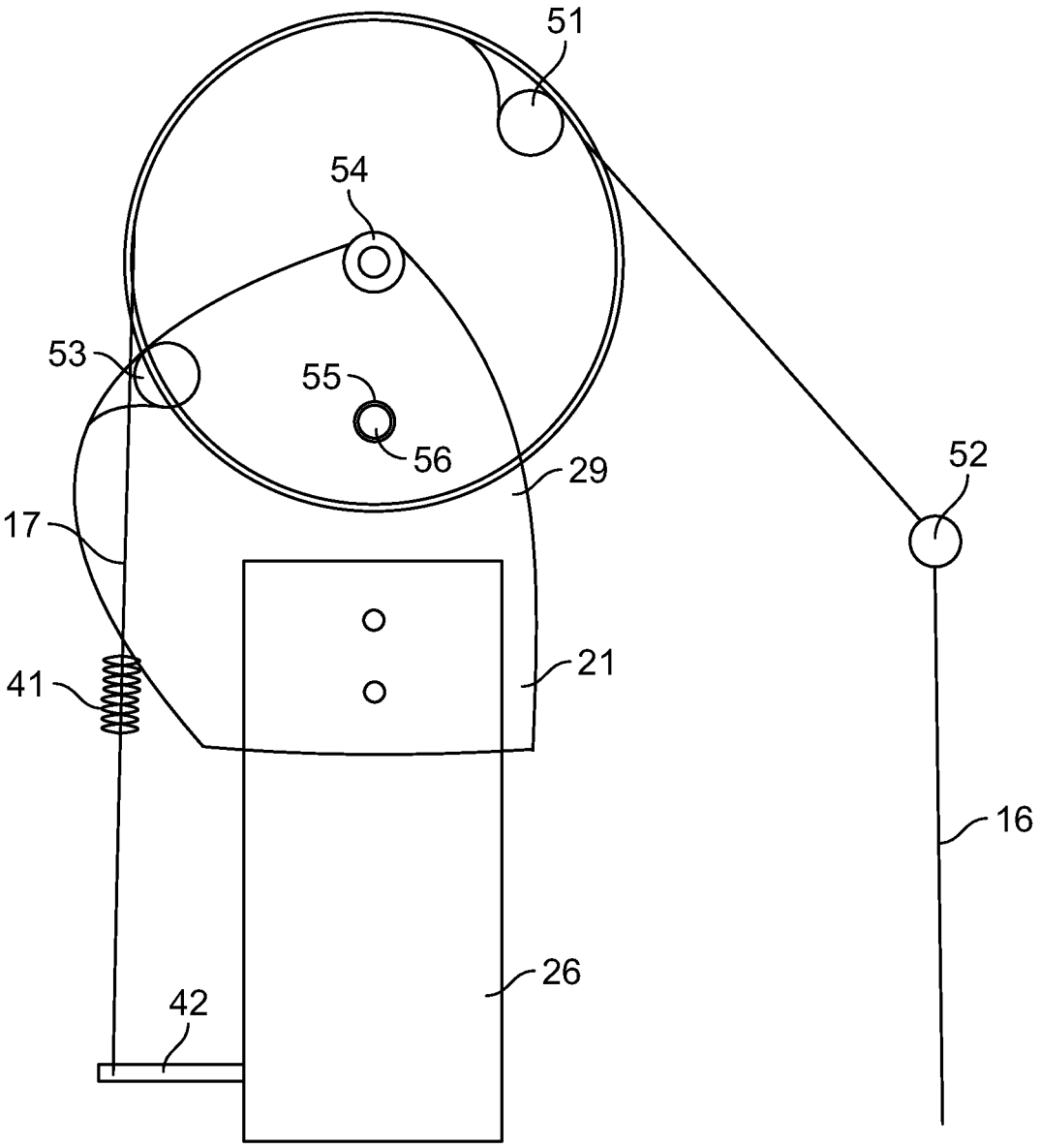
FIG. 6 is a diagram of the pulley system showing the pulley notch engagement mechanism.

As seen in FIG. 6, the endcap body 29 attaches the pulley to the top end of the enclosure pole. In FIG. 6, the endcap body 29 is drawn as a transparent item for clarity, but in actual production the endcap body 29 should be a high density plastic resin with opaque UV resistant material. The pulley notch 51 can catch and hook onto the enclosure top support 52. The enclosure top support 52 can be formed of a reinforced fabric, flexible steel or fiberglass ring that provides a flexible frame that the enclosure netting hangs from. The pulley notch 51 of the pulley rotates to the outside and can attach to the enclosure top support 52. The endcap notch 53 can align with the pulley notch 51 so that the pulley notch 51 pulls the enclosure top support 52 into the endcap notch 53. Since the endcap notch 53 is also formed as a hook with a slot, the combination of the endcap notch 53 and the pulley notch 51 can retain the enclosure top support 52 to the endcap. The pulley optionally has a pulley bearing 54 to provide improved rotation.

The pulley can have a pulley retainer with a pulley retainer opening 55. The pulley retainer opening 55 extends through the pulley and the endcap. A retaining stopper 56 can be formed as a rod and insert into the pulley retainer opening 55 so that the pulley and the endcap are secured to each other which would stop the rotation of the pulley. The retaining stopper 56 can be threaded, or have a ball detent release. A user can insert the retaining stopper 56 into the pulley retainer opening 55 to stop rotation and then retract the retraining stopper 56 to permit rotation. A lead line can be attached between the enclosure top support 52 and the enclosure net 16. The lead line can be long enough to match the exposed length of the pulley so that the net does not touch the pulley.

When a user assembles the trampoline, the user connects the pulley line to the enclosure top support. Then the user pulls on the free end of the pulley line to raise the enclosure top support. In this way, the user does not need to get a ladder or to be in a precarious position to raise the enclosure top support. In the prior art, the enclosure top support must be manually lodged into the supporting end cap which can potentially be dangerous for some users. Also, the tensioner can act as a damper for dissipating energy when a user lands in the net. When a user lands in the net, the net catches the user, then pulls down on the net support. The net support pulls on the pulley line which rotates the pulley against the tensioner. The tensioner can contact the pulley or the pulley line and convert the kinetic energy of the falling user into friction heat energy.

The invention claimed is:

1. A trampoline comprising:

a. a trampoline frame with trampoline legs supporting the trampoline frame above a ground;

b. trampoline springs connected to the trampoline frame;

c. a trampoline bed connected to the trampoline springs, wherein the trampoline bed is extended across the trampoline frame;

d. a trampoline enclosure comprising at least one enclosure pole supporting an enclosure net; and e. a pulley system mounted to the at least one enclosure pole, wherein the pulley system includes a pulley mounted to a pulley line, wherein the pulley line connects to an enclosure top support, wherein the enclosure net is connected to the enclosure top support further comprising a tensioner having a tensioner handle, wherein a user is capable of controlling a tension of the pulley line using the tensioner handle, wherein the tensioner engages the pulley line to increase tension by retaining the pulley line with a variable force, wherein the pulley system further includes an endcap securing the pulley to the at least one enclosure pole, wherein the end cap has an endcap socket for fitting over an upper end of the at least one enclosure pole, wherein both the pulley and the tensioner handle are mounted on the endcap.

2. The trampoline of claim 1, further comprising a free end of the pulley line, wherein the free end of the pulley line extends away from the pulley to be accessible to a user.

3. The trampoline of claim 1, further comprising a pulley notch formed on the pulley, wherein the pulley notch is configured to retain a portion of the enclosure top support.

4. The trampoline of claim 1, wherein the endcap further includes an end cap notch wherein the end cap notch is configured to receive and retain a portion of the enclosure top support.

5. The trampoline of claim 1, further including a spring cover covering the trampoline springs, wherein the spring cover is inflatable.

6. The trampoline of claim 1, wherein the enclosure net is a double net with an inside net attached to an inside circumference of a spring cover and with an outside net attached to an outside circumference of the spring cover, wherein the inside net and the outside net overlap each other.

7. The trampoline of claim 1, further comprising: a free end of the pulley line, wherein the free end of the pulley line extends away from the pulley to be accessible to the user; further comprising a pulley notch formed on the pulley, wherein the pulley notch is configured to retain a portion of the enclosure top support, wherein the endcap further includes an end cap notch wherein the end cap notch is configured to receive and retain a portion of the enclosure top support, further including a spring cover covering the trampoline springs, wherein the spring cover is inflatable wherein the enclosure net is a double net with an inside net attached to an inside circumference of the spring cover and with an outside net attached to an outside circumference of the spring cover, wherein the inside net and the outside net overlap each other.

* * * * *